US008484791B2

(12) United States Patent
Lin

(10) Patent No.: US 8,484,791 B2
(45) Date of Patent: Jul. 16, 2013

(54) TOILET CLEANING PAD

(76) Inventor: Chien H. Lin, Temple City, CA (US)

( * ) Notice: Subject to any disclaimer, the term of this patent is extended or adjusted under 35 U.S.C. 154(b) by 1081 days.

(21) Appl. No.: 12/387,857

(22) Filed: May 7, 2009

(65) Prior Publication Data

US 2010/0281641 A1 Nov. 11, 2010

(51) Int. Cl.
*A47K 11/10* (2006.01)
*E03D 9/00* (2006.01)

(52) U.S. Cl.
USPC ..... 15/104.93; 15/208; 4/223; 4/661; 134/6

(58) Field of Classification Search
USPC ..... 15/104.93, 104.94, 210.1, 208; 4/300.3, 4/222, 223, 231, 661; 134/6
See application file for complete search history.

(56) References Cited

U.S. PATENT DOCUMENTS

| | | | | |
|---|---|---|---|---|
| 3,121,249 | A * | 2/1964 | Affleck et al. | 15/104.93 |
| 6,081,937 | A | 7/2000 | Whitacre | |
| 6,112,898 | A | 9/2000 | Siragusa et al. | |
| 6,564,399 | B1 | 5/2003 | Teal | |
| 6,833,340 | B2 | 12/2004 | Lefenfeld et al. | |
| 2009/0113613 | A1 * | 5/2009 | Kole | 4/300.3 |

FOREIGN PATENT DOCUMENTS

EP 1134282 A1 * 9/2001

* cited by examiner

*Primary Examiner* — Laura C Guidotti
(74) *Attorney, Agent, or Firm* — Gary F. Wang, Esq.

(57) ABSTRACT

The present invention consists of a pad that is curved to fit the inside surface of a toilet. The pad is large enough to cover the entire inside surface of the toilet. The lower portion of the pad is submerged into the trapped water at the bottom of the toilet. A part of the trapped water sucks up to the pad through the fibers of the pad materials. The wet pad stays on the surface of the toilet bowl. The leaning agent stored in the cleaning pad works with the stain on the bowl surface to clean the surface.

15 Claims, 5 Drawing Sheets

TOILET CLEANING PAD

BACKGROUND OF THE INVENTION

1. Field of the Invention

The invention is related to a toilet-cleaning pad made by paper or other fine fiber materials where the pad is pre-saturated or pre-packed with cleaning agents.

2. Description of the Related Art

The more conventional ways to clean the toilet usually involve spreading the cleaning liquids or agents onto the surface of the toilet. Due to the gravity most of cleaning liquids quickly slide to the bottom of the toilet. Because of that the cleaning liquids usually do not have enough time to act with the surface to reach their maximum cleaning effects.

There are some patents that related to the toilet leaning. For example, U.S. Pat. No. 6,081,937 is directed to an apparatus that can be placed in a toilet bowl to absorb a stream of liquid and prevent it from splashing out of the bowl. The apparatus is made of three layers, a top flat layer of liquid permeable material, the second layer is a liquid absorbing material that could be formed from a plurality of sheets of double ply toilet tissue. The third layer is similar to the first layer of concave shape. The apparatus is generally circular and sealed together at the edge and sized to substantially cover the surface of the water in a standard commode. With the apparatus in place floating on the top of the water a stream of liquid would pass through the first layer, be absorbed by the second layer and be prevented from splashing outside of the commode. U.S. Pat. No. 6,833,340 is directed to a biolayer capsule or tablet comprised of soluble polymer containing active ingredients for odor blocking and disinfecting the toilet. These devices can be safely carried in pocket or purse and dropped into a toilet bowl providing fast action. When the action is completed the apparatus can easily be flushed down the toilet.

U.S. Pat. No. 6,564,399 is directed to a flushable bowl protecting liner for reducing the need for manual cleaning of the toilet. The liner may be floated on the top of the toilet bowl above water level. As solid waste is deposited onto the material it will drop into the water allowing the material to soften and wrap around the waste material. The liner may include other substances incorporated into or coated onto the liner such as a fragranced disbursing substance, antiseptic or antibiotic substance, enzymes and/or bacteria that may assist in decomposing the liner and waste, and a frictional reducing coating that makes the exterior of the liner slippery to ease its passage through the plumbing. U.S. Pat. No. 6,112,898 is directed to multiple compacted solids and packages thereof containing two automatic toilet bowl cleaners. One package contains a detergent and the other a bleaching agent that are separate until placed in a toilet bowl whereby they get wet and release their contents.

However, none of above-mentioned patents takes care of the problem as to the cleaning liquids quickly slide to the bottom of the toilet because of the gravity. The present invention revolves the problem efficiently and effectively.

SUMMARY OF THE INVENTION

The present invention consists of a pad that is curved to fit the inside surface of a toilet. The pad is large enough to cover the entire inside surface of the toilet. The lower portion of the pad is submerged into the trapped water at the bottom of the toilet. As mentioned above, the pad is saturated with cleaning agents. When the bottom portion of the pad submerged in the trapped water, the pad starts to suck up the trapped water due to the capillary effect. The sucked-up water and the saturated cleaning agents cause the pad to stay on the surface of the toilet. This will allow the cleaning agents enough time to act with the surface to reach the maximum cleaning effect.

The pad can be either disposable or dissolvable. The disposable pad is used in the same way as the dissolvable pad. The disposable pad is collected from the toilet surface after its use and disposed accordingly. The dissolvable pad is not collected after its use. The remains of the dissolvable pad is flushed away with flushing of the toilet.

The pad can be also used on other surfaces, such as sinks, in the restrooms and kitchens. For this reason, the prior art search should cover those cleaning pads that soak cleaning agents and stay on the cleaning surfaces for a certain period of time to make the cleaning agents act with the surface regardless what surfaces the pads are on.

In one embodiment of the invention, a toilet cleaning pad comprising a piece of a flexible material having a upper portion and a lower portion covering and staying on significant part of an inner surface of a toilet bowl, the upper portion of the flexible material being placed along a top inner edge of the toilet bowl, the lower portion of the flexible material being submerged in trapped water, the flexible material being saturated with a cleaning agent and wherein the trapped water being sucked into the flexible material with capillary actions, the trapped water reacting with the cleaning agent and cleaning the covered portion of the inner surface of the toilet bowl.

In another embodiment of the invention, the above described embodiment wherein the flexible material is made of materials with fine fibers capable of causing capillary actions to suck a part of the trapped water into the material; wherein the flexible material is tailored into a shape that will fit the inner surface of the toilet bowl; wherein the lower portion of the flexible material has a plurality of wings extending downwardly into trapped water; wherein the cleaning agent is mixed chemicals commonly used for bathroom cleaning; wherein the cleaning agent is in a form of fine particles; wherein the cleaning agent is in a paste form soaked with the flexible material.

In also another embodiment of the invention, the above first described embodiment, the flexible material further comprising a top layer, a bottom layer, a cleaning agent in a form of fine particles and wherein the cleaning agent is placed between the top layer and bottom layer, and both the top layer and the bottom layer being weaved together with the cleaning agent to form a single piece flexible material.

In yet another embodiment of the invention, a method of using a toilet cleaning pad comprising the steps of a placing a piece of a flexible material having a upper portion and a lower portion onto significant part of an inner surface of a toilet bowl, a aligning the edge of the upper portion of the flexible material with a top inner edge of the toilet bowl, submerging a part of the lower portion of the flexible material in trapped water on the bottom of the toilet bowl, causing the flexible material being saturated with a cleaning agent, and wherein the trapped water being sucked into the flexible material with capillary actions, the trapped water reacting with the cleaning agent and cleaning the covered portion of the inner surface of the toilet bowl.

In another embodiment of the invention, in the method of using the toilet cleaning pad described in the above paragraph, wherein the flexible material is made of materials with fine fibers capable of causing capillary actions to suck a part of the trapped water into the material; wherein the flexible material is tailored into a shape that will fit the inner surface of the toilet bowl; wherein the lower portion of the flexible material has a plurality of wings extending downwardly into trapped water; wherein the cleaning agent is mixed chemicals commonly used for bathroom cleaning; wherein the cleaning agent is in a form of fine particles; wherein the cleaning agent is in a liquid form soaked with the flexible material; and the flexible material further comprising a top layer, a bottom layer, a cleaning agent in a form of fine particles, and wherein the cleaning agent is placed between the top layer and bottom layer, and both the top layer and the bottom layer being weaved together with the cleaning agent to form a single piece flexible material.

In yet another embodiment of the invention, a toilet cleaning pad comprising a piece of a flexible material, made of materials with fine fibers capable of causing capillary actions to suck a part of the trapped water into the material, having a upper portion and a lower portion covering and staying on significant part of an inner surface of a toilet bowl, wherein the flexible material is tailored into a shape that will fit the inner surface of the toilet bowl, the lower portion of the flexible material has a plurality of wings extending downwardly into trapped water, the upper portion of the flexible material being placed along a top inner edge of the toilet bowl, the lower portion of the flexible material being submerged in the trapped water, the flexible material being saturated with a cleaning agent, wherein the cleaning agent is mixed chemicals commonly used for bathroom cleaning in a form of either fine particles or a liquid form soaked with the flexible material, and wherein the trapped water being sucked into the flexible material with capillary actions, the trapped water reacting with the cleaning agent and cleaning the covered portion of the inner surface of the toilet bowl.

In another embodiment of the invention, in the embodiment in the above paragraph, the flexible material further comprising a top layer, a bottom layer, a cleaning agent in a form of fine particles, and wherein the cleaning agent is placed between the top layer and bottom layer, and both the top layer and the bottom layer being weaved together with the cleaning agent to form a single piece flexible material.

BRIEF DESCRIPTION OF THE DRAWING

These and other features, aspects and advantages of the present invention will become better understood with regard to the following description, appended claims, and accompanying figure where:

DETAILED DESCRIPTION OF THE PREFERRED EMBODIMENTS

One of the purposes of this invention is to develop a cleaning pad that is curved to fit the inside of the toilet bowl and large enough to cover the entire surface of the inside toilet bowl. The following is a description of one way that this is accomplished.

Figure 1:
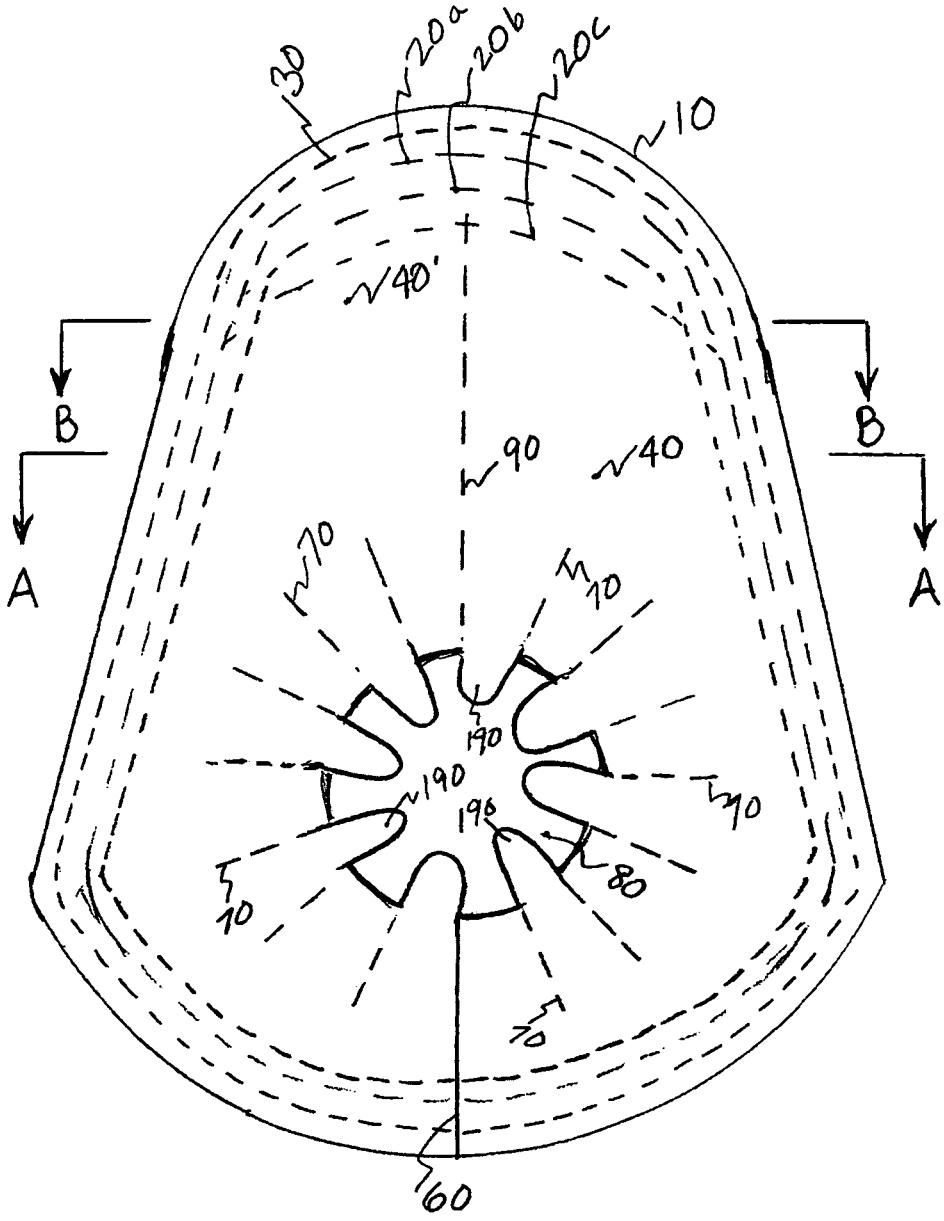
FIG. 1. A cleaning pad with a number of cuts on the pads for the purpose of making the pad fit the toilet bowl.
Figure 1A:
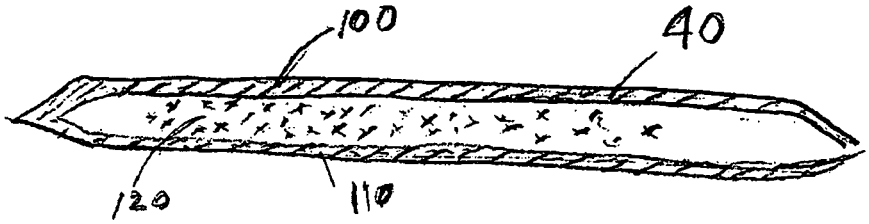
FIG. 1A. A cross-section view of the flat type of a cleaning pad body.
Figure 1B:
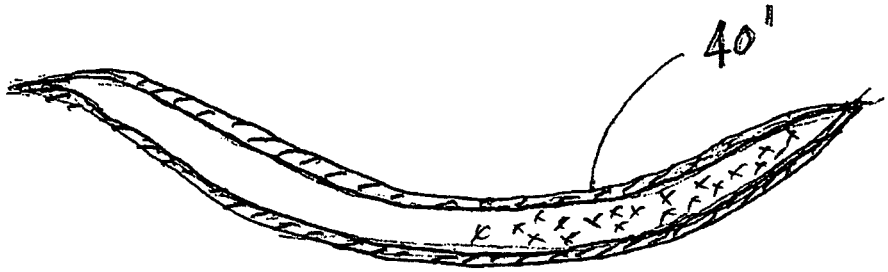
FIG. 1B. A cross-section view of the curved type of a cleaning pad body.

The FIG. 1 depicts a top view of a typical pad 10. The dashed lines 20*a*, 20*b* and 20*c* indicate perforated holes on the pad that allow users to tear the extra portion of the pad to fit the size of the bowl surface. These perforated holes can be extended to cover the entire edge of the pad, as indicated in the dashed line 30, for the same purpose. The pad body 40 can in two different shapes. One of the shapes is flat as depicted in FIG. 1A. The other shape of the pad body 40' is curved downward to form a bowl-shaped body, as depicted in FIG. 1B, to fit the toilet bowl surface 50. The line 60 depicted in FIG. 1 is a cut-through opening on the pad body 40 or 40'. A plural of dashed lines 70 around a circular opening 80 represents perforated holes for tearing if needed. When the pad 10 is ready to be fitted onto the toilet bowl surface 50, some or all of the perforated lines 70 can be torn to make the pad 10 to fit the contour of the surface 50. Therefore, the number of the perforated lines 70 is not critical so long as they are enough to make the pad 10 have a good fit to the surface 50. A dashed line 90 depicted in FIG. 1 also represents perforated holes. The line 90 can be torn when needed for fitting the surface 50.

When the pad 10 is ready to be fitted to the surface 50, users can break the appropriate perforated holes among 20*a*, 20*b*, 20*c*, 30, 70 and 90 to make the best fit to the surface 50. Since there is an opening 60, both side of the opening 60 can be overlapped in various amount of overlapping to further adjust the fitness of the pad 10 the surface 50.

FIG. 1A depicts a cross-section view of the flat type of a cleaning pad body 40. FIG. 1B depicts a cross-section view of the curved type of a cleaning pad body 40'. Besides the obvious differences in their cross-section shapes, both types of the pads 10 are essentially the same. As mentioned above, the differences in shape are prepared to make the pads 10 fit better with the bowl surface 50. The cross-sections of the pad 10 shown in FIG. 1A and FIG. 1B reveal three sections. The top section 100 and the bottom section 110 are made of flexible materials with fibers such as paper, cotton and other materials that are capable of causing capillary actions to saturate the pad 10 with water. The section between the top section 100 and the bottom section 110 contains cleaning agent 120 that is mixed chemicals commonly used for bathroom cleaning. The cleaning agent 120 is usually in fine particles or paste form. The cleaning agent 120 is capable of dissolving and reacting with the dirty surface of the toilet bowl when it gets wet.

Figure 2:
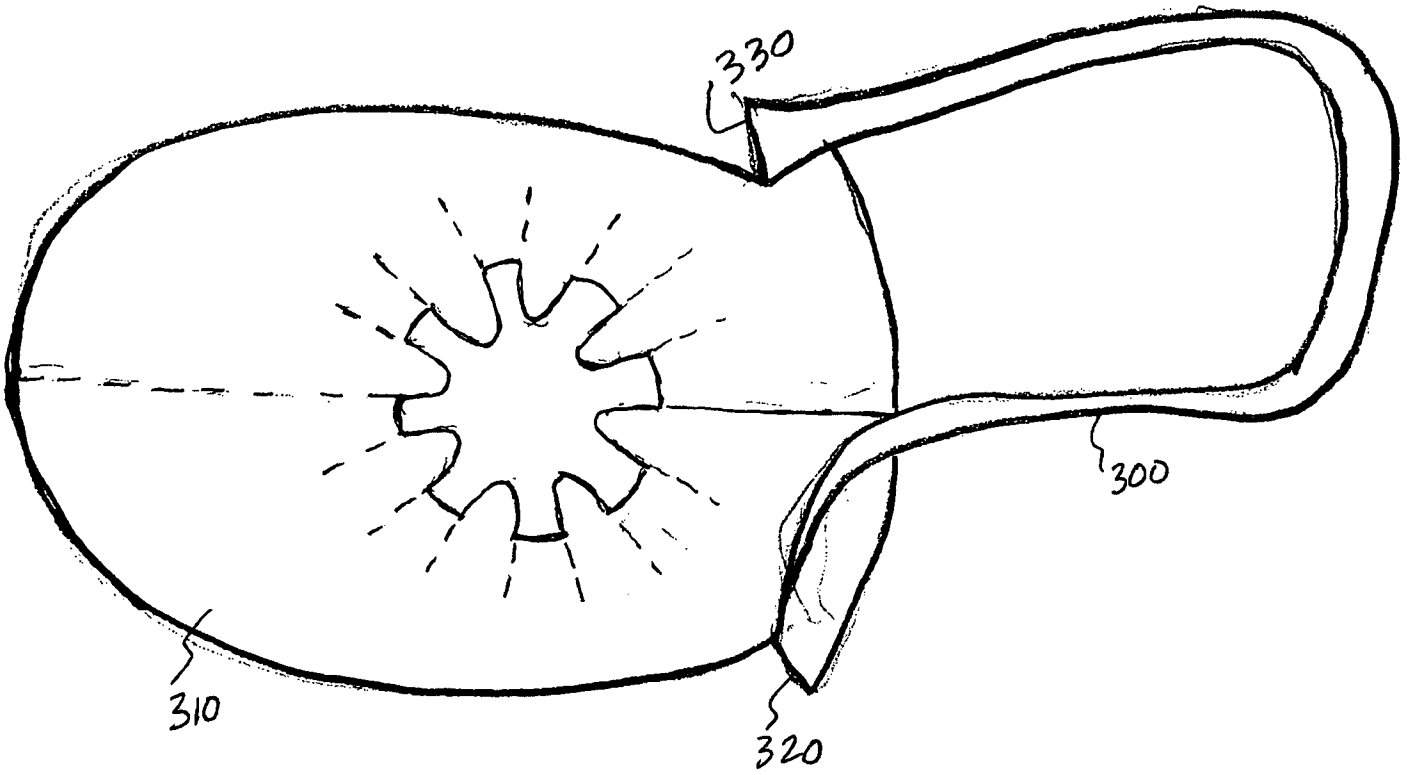
FIG. 2. A prospective view depicting a cleaning pad with a part of its edge being torn to form a handle.

In another embodiment of the invention as depicted in FIG. 2, the perforated holes indicated by the dashed lines 20*a*, 20*b*, 20*c* and 30 can be torn to fit the size of the bowl surface 50, and the torn-off part can be used as a handle 300 for handling the used pad 310 for disposal. When using a disposable pad, i.e. a non-dissolvable pad, the pad 10 needs to be disposed as a waste after the use. To avoid a direct handling of the waste pad 310, the perforated holes indicated by the dashed lines 20*a*, 20*b*, 20*c* and 30 can be torn to stop points 320 and 330. The stop pints 320 and 330 can be anywhere along the dashed lines 20*a*, 20*b*, 20*c* and 30, so long as the stop points 320 and 330 does not come too close to each other so that the space between the stop points 320 and 330 can support the lift of the handle 300 when the used pad 310 is lifted.

Figure 3:
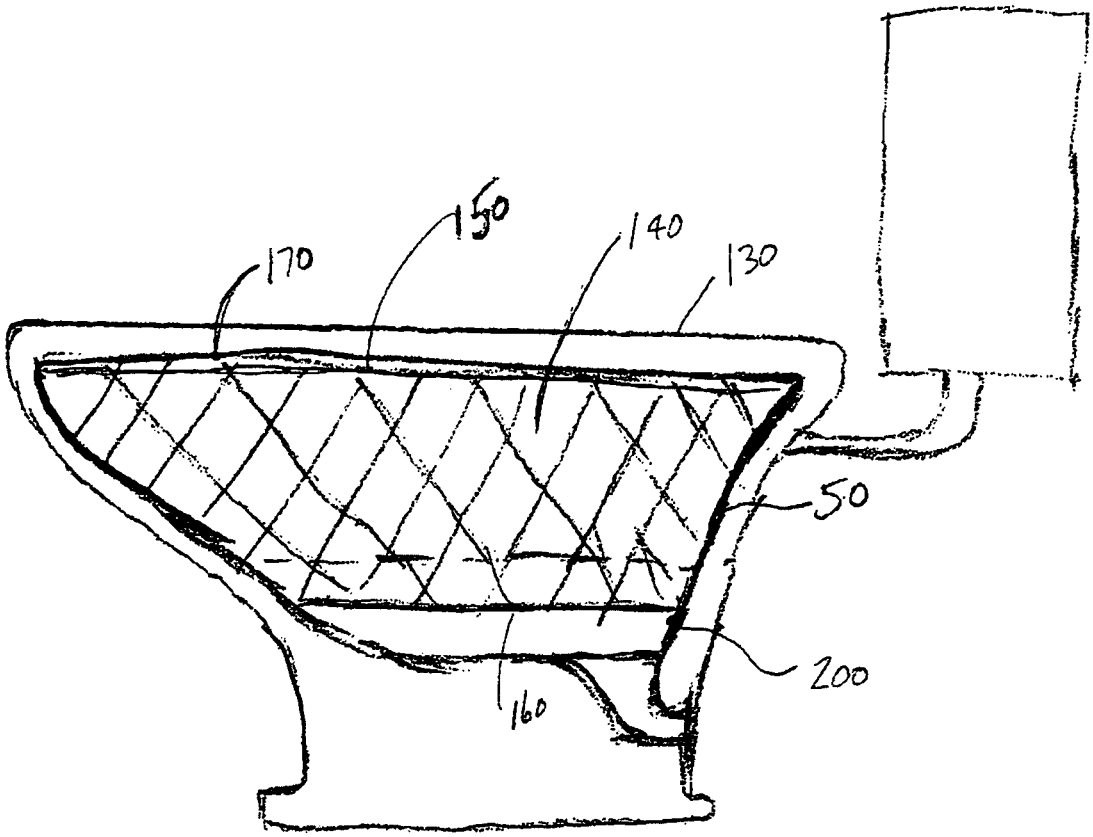
FIG. 3. A cross section view of a toilet with a cleaning pad sticking on the entire surface of the toilet bowl using the cleaning pad depicted in FIG. 1.

FIG. 3 depicts a cross section view of a toilet 130 with a cleaning pad 10 sticking on the entire surface 50 of the toilet bowl 130 using the cleaning pad 10 depicted in FIG. 1. A piece of a flexible material 140 having a upper portion 150 and a lower portion 160 covers and stays on significant part of the inner surface 50 of the toilet bowl 130. The upper portion 150 of the flexible material 140 is placed along a top inner edge of the toilet bowl 170. The lower portion 160 of the flexible material 140 is submerged in trapped water 180. The flexible material 140 is saturated with the cleaning agent 120. The trapped water 180 is sucked into the flexible material 140 with capillary actions, and the trapped water 180 reacts with the cleaning agent 120 and cleans the covered portion of the inner surface 50 of the toilet bowl 130. The cleaning agent 120 in the cleaning pad 10 can also be in a liquid form after soaking with trapped water 180.

As mentioned above, the flexible material 140 in the cleaning pad 10 is made of any materials with fine fibers that are capable of causing capillary actions to suck a part of the trapped water 180 into the material 140. The flexible material 140 can also be tailored into a shape that will fit the inner surface 50 of the toilet bowl 130. The lower portion 160 of the flexible material 140 has a plurality of wings 190 as shown in FIG. 1 extending downwardly into trapped water 180 for securing the water being sucked into the flexible material 140.

The flexible material 140 of the cleaning pad 10 has a top layer 100, a bottom layer 110 and the cleaning agent 120 in the middle. Both the top layer 100 and the bottom layer 110 are weaved together with the cleaning agent 120 in the middle to form a single piece flexible material 140.

Figure 4:
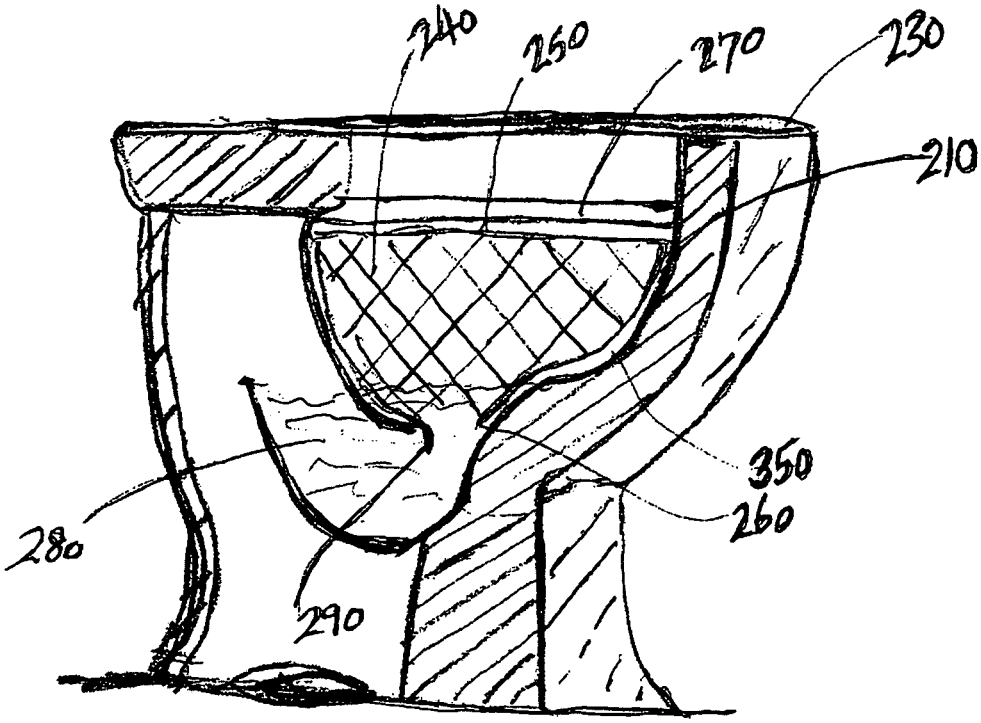
FIG. 4. A cross section view of a toilet with a cleaning pad sticking on the surface of the toilet bowl and a lower portion of the pad submerged in trapped water.

In another embodiment as shown in FIG. 4, a cleaning pad 210 sticking on the entire surface 350 of the toilet bowl 230. An upper portion 250 of a flexible material 240 covers along the inner edge 270 of the toilet 230 and lower edge 260 stays in the trapped water 280. The cleaning pad 210 covers and stays on significant part of the inner surface 350 of the toilet bowl 230. The upper portion 250 of the flexible material 240 is placed along a top inner edge of the toilet bowl 270. The lower portion 260 of the flexible material 240 is submerged in trapped water 280. The flexible material 240 is saturated with the cleaning agent 120. The trapped water 280 is sucked into the flexible material 240 with capillary actions, and the trapped water 280 reacts with the cleaning agent 120 and cleans the covered portion of the inner surface 350 of the toilet bowl 230. The cleaning agent 120 in the cleaning pad 210 can also be in a liquid form after soaking with trapped water 280. The wing 290 is placed downward which is submerged in the trapped water 280 to ensure the water being sucked up by capillary effects through the fine fibers in the flexible material 240.

There are several steps involved when using a cleaning pad 10. First, placing a piece of cleaning pad 10 which is made of a flexible material 140 having a upper portion 150 and a lower portion 160 onto an inner surface 50 of a toilet bowl 130. Secondly, aligning the edge of the upper portion 150 of the flexible material 140 with a top inner edge 170 of the toilet bowl 130. Then, submerging a part of the lower portion 160 of the flexible material 140 in trapped water 180 on the bottom 200 of the toilet bowl 130. Since the flexible material 140 is being saturated with a cleaning agent 120, when it is soaked with the water in the trapped water 180 causing by the capillary actions, the trapped water 180 reacts with the cleaning agent 120 and cleans the covered portion of the inner surface 50 of the toilet bowl 130.

In the other embodiment, the lower portion 160 also has a plurality of wings 190. When submerging the lower portion 160 of the flexible material 140 in trapped water 180 on the bottom 200 of the toilet bowl 130, the wings 190 ensures the lower portion 160 will be in touch with the trapped water 180.

The lower portion 160 of the pad 10 is submerged into the trapped water 180 at the bottom 200 of the toilet 130. As mentioned above, the pad 10 is saturated with cleaning agents 120. When the bottom portion 160 of the pad 10 submerged in the trapped water 180, the pad 10 starts to suck up the trapped water 180 due to the capillary effect. The sucked-up water and the saturated cleaning agents cause the pad 10 to stay on the surface 50 of the toilet 130. This will allow the cleaning agents 120 enough time to act with the surface 50 to reach the maximum cleaning effect.

The pad 10 can be either disposable or dissolvable. The disposable pad is used in the same way as the dissolvable pad. The disposable pad is collected from the toilet surface 50 after its use and disposed accordingly. The dissolvable pad is not collected after its use. The remains of the dissolvable pad are flushed away with flushing of the toilet 130.

The pad can be also used on other surfaces, such as sinks, in the restrooms and kitchens. For this reason, the prior art search should cover those cleaning pads that soak cleaning agents and stay on the cleaning surfaces for a certain period of time to make the cleaning agents act with the surface regardless what surfaces the pads are on.

Although the present invention has been discussed in considerable detail with reference to certain preferred embodiments, other embodiments are possible. Therefore, the scope of the appended claims should not be limited to the description of preferred embodiments contained in this disclosure.

What is claimed is:

1. A toilet cleaning pad comprising:

a. a piece of a flexible material having a upper portion and a lower portion covering and staying on significant part of an inner surface of a toilet bowl;

b. the upper portion of the flexible material being placed along a top inner edge of the toilet bowl;

c. the lower portion of the flexible material being submerged in trapped water; and d. the flexible material being saturated with a cleaning agent;

wherein the flexible material further comprises a top layer; a bottom layer; and a cleaning agent that is placed between said top layer and bottom layer in a form of fine particles, both the top layer and the bottom layer being weaved together with the cleaning agent to form a single piece flexible material, and wherein the lower portion of the flexible material has a plurality of wings extending downwardly into trapped water, and the trapped water being sucked into the flexible material with capillary actions, the trapped water reacting with the cleaning agent and cleaning the covered portion of the inner surface of the toilet bowl.

2. The toilet cleaning pad of claim 1, wherein the flexible material is made of materials with fine fibers capable of causing capillary actions to suck a part of the trapped water into the material.

3. The toilet cleaning pad of claim 1, wherein the flexible material is tailored into a shape that will fit the inner surface of the toilet bowl.

4. The toilet cleaning pad of claim 1, wherein the cleaning agent is mixed chemicals commonly used for bathroom cleaning.

5. The toilet cleaning pad of claim 1, wherein the cleaning agent is either in a form of fine particles or in paste form.

6. The toilet cleaning pad of claim 1, wherein the part of the cleaning pad can be torn off to form a handle for lifting a used cleaning pad.

7. The toilet cleaning pad of claim 1, wherein the cleaning agent is in a liquid form soaked with the flexible material.

8. A method of using a toilet cleaning pad comprising the steps of:

a. placing a piece of a flexible material having a upper portion and a lower portion onto significant part of an inner surface of a toilet bowl;

b. aligning the edge of the upper portion of the flexible material with a top inner edge of the toilet bowl;

c. submerging a plurality of wings of the lower portion of the flexible material extending downwardly in trapped water on the bottom of the toilet bowl; and d. causing the flexible material being saturated with a cleaning agent;

wherein the flexible material further comprises a top layer; a bottom layer; and a cleaning agent that is placed between said top layer and bottom layer in a form of fine particles, both the top layer and the bottom layer being weaved together with the cleaning agent to form a single piece flexible material, and wherein the trapped water being sucked into the flexible material with capillary actions, the trapped water reacting with the cleaning agent and cleaning the covered portion of the inner surface of the toilet bowl.

9. The method of using the toilet cleaning pad of claim 8, wherein the flexible material is made of materials with fine fibers capable of causing capillary actions to suck a part of the trapped water into the material.

10. The method of using the toilet cleaning pad of claim 8, wherein the flexible material is tailored into a shape that will fit the inner surface of the toilet bowl.

11. The method of using the toilet cleaning pad of claim 8, wherein the cleaning agent is mixed chemicals commonly used for bathroom cleaning.

12. The method of using the toilet cleaning pad of claim 8, wherein the cleaning agent is either in a form of fine particles or in paste form.

13. The method of using the toilet cleaning pad of claim 8, wherein the part of the cleaning pad can be torn off to form a handle for lifting a used cleaning pad.

14. The method of using the toilet cleaning pad of claim 8, wherein the cleaning agent is in a liquid form soaked with the flexible material.

15. A toilet cleaning pad comprising:

a. a piece of a flexible material, made of materials with fine fibers capable of causing capillary actions to suck a part of the trapped water into the material, having a upper portion and a lower portion covering and staying on significant part of an inner surface of a toilet bowl, wherein the flexible material is tailored into a shape that will fit the inner surface of the toilet bowl;

b. the lower portion of the flexible material has a plurality of wings extending downwardly into trapped water;

c. the upper portion of the flexible material being placed along a top inner edge of the toilet bowl;

d. the lower portion of the flexible material being submerged in the trapped water;

e. the flexible material being saturated with a cleaning agent, wherein the cleaning agent is mixed chemicals commonly used for bathroom cleaning in a form of either fine particles or a paste form soaked with the flexible material;

f. an edge of the flexible material being capable of tearing off to form a handle that can be lifted after the cleaning pad is used; and wherein the trapped water being sucked into the flexible material with capillary actions, the trapped water reacting with the cleaning agent and cleaning the covered portion of the inner surface of the toilet bowl, wherein the flexible material further comprises a top layer; a bottom layer; and a cleaning agent that is placed between said top layer and bottom layer in a form of fine particles, both the top layer and the bottom layer being weaved together with the cleaning agent to form a single piece flexible material.

* * * * *